United States Patent [19]

King

[11] Patent Number: 5,065,879

[45] Date of Patent: Nov. 19, 1991

[54] COLLAPSIBLE MULTI-LAYER INSULATOR FOR A BEVERAGE CONTAINER

[76] Inventor: Byron King, Ste. 237, Red Hook Plz., St. Thomas, V.I. 00802

[21] Appl. No.: 640,868

[22] Filed: Jan. 14, 1991

[51] Int. Cl.[5] ..... B65D 23/08

[52] U.S. Cl. ..... 220/739; 150/154; 150/901; 229/91; 383/121.1; 220/907

[58] Field of Search ..... 150/154, 901; 229/89, 229/91; 220/85 H; 215/100 R; 383/121.1

[56] References Cited

U.S. PATENT DOCUMENTS

| | | | |
|---|---|---|---|
| 1,802,479 | 4/1931 | Robinson | 383/121.1 |
| 2,415,956 | 2/1947 | Mamaux | 383/121.1 |
| 4,040,549 | 8/1977 | Sadier | 220/85 H |
| 4,181,765 | 1/1980 | Harmony . | |
| 4,194,627 | 3/1980 | Christensen . | |
| 4,282,279 | 8/1981 | Strickland . | |
| 4,290,466 | 9/1981 | Villa et al. . | |
| 4,372,453 | 2/1983 | Branscum . | |
| 4,401,245 | 8/1983 | Zills . | |
| 4,681,239 | 7/1987 | Manns et al. | 220/85 H |
| 4,844,286 | 7/1989 | Jacobson | 150/154 |
| 4,871,597 | 10/1989 | Hobson . | |
| 4,930,644 | 6/1990 | Robbins, III | 383/121.1 |
| 4,974,741 | 12/1990 | Gustafson et al. | 220/85 H |

*Primary Examiner*—Gary E. Elkins
*Attorney, Agent, or Firm*—Foley & Lardner

[57] ABSTRACT

A multi-layer insulator for a beverage container which includes an externally threaded base and a main sleeve extending upwardly from the base and having a collapsible side wall. The main sleeve comprises an exterior fabric layer, an interior fabric or neoprene layer, and an intermediate insulation layer. The lid for the insulator has internal threads for screwing the lid over the externally threaded base assembly, such that when the insulator is not in use the main sleeve is collapsible into the base with the lid screwed on the base to enclose the sleeve. When the insulator is in use, the lid is unscrewed from the base, the main sleeve is extended to receive the container and the lid is inverted and screwed to the base from the bottom thereof, functioning essentially as a coaster. The multi-layer insulator also has a closure band at the upper end of the main sleeve, with the band being adjustable to accept beverage containers of varying diameter.

8 Claims, 2 Drawing Sheets

COLLAPSIBLE MULTI-LAYER INSULATOR FOR A BEVERAGE CONTAINER

BACKGROUND OF THE INVENTION

1. Field of the Invention

The present invention relates to an insulator and carrier for beverage containers and more particularly to a multi-layer and collapsible insulative carrier.

2. Description of the Related Art

Carriers or coolers for beverage containers are especially useful in hot or tropical climates. In earlier designs these coolers included for example, a quilted jacket with a flap. The container fit into the open end of the jacket and the flap was used as a cover. Although the quilted material was of a multi-layer design which included exterior and interior fabric layers with an insulative layer therebetween, there was no attention paid to the resulting condensation inside the jacket and the excess water produced could therefore leak out of the carrier. Furthermore, the insulative layer was frequently inadequate for insulating purposes in extremely hot or tropical climates.

In addition, coolers of this design, although collapsible, failed to provide a carrying case for the container to keep it from getting damaged when not in use. Further, frequently no support bases were provided for these earlier designs so that support for the container was obtained from the beverage container itself. As such, these earlier insulated coolers were susceptible to being easily tipped over, particularly in situations where they were placed on slightly unlevel surfaces.

SUMMARY OF THE INVENTION

It is an object of the present invention to provide a collapsible multi-layer insulator for a beverage container which is sufficiently insulated to prevent excessive condensation from forming on the inside of the insulator.

It is yet another object of the present invention to provide a collapsible multi-layer insulator which has a detachable lid which can be attached to a base portion of the insulator thereby providing a solid foundation for supporting the container when it is placed in the insulator.

It is yet another object of the invention to provide a collapsible multi-layer insulator wherein the collapsible sidewalls of the insulator are contained within the lid and base when not in use.

Another object of the invention is to provide a collapsible multi-layer insulator which can be adjusted to fit a variety of different sized containers.

In one aspect of the present invention, a multi-layer collapsible and insulative carrier has an externally threaded base having top and bottom surfaces with a hole disposed in the center of said bottom surface and a main sleeve extending upwardly from the top surface of the base. The main sleeve has an open upper end for receiving the container and has collapsible side walls and a bottom wall. The side walls are comprised of an exterior fabric layer, an interior fabric layer spaced from the exterior layer, and a layer of insulating material between the interior and exterior layers. The carrier also has a base plate attached to the bottom wall of the main sleeve thereby forming a base assembly with the externally threaded base to provide an enlarged, more stable support for the container. A connecting means is secured to and extends through the bottom wall of the main sleeve and through the hole in said base for interconnecting the main sleeve and the base. The carrier also has a lid with internal threads for screwing the lid onto the externally threaded base, such that when the carrier is not in use the main sleeve can collapse into the base with the lid being screwed on top of the base and the collapsed main sleeve, thereby enclosing the sleeve. When the carrier is in use, the lid can be unscrewed, the sleeve extended to receive the container, and the lid turned upside-down and screwed to the bottom of the base to provide an enlarged more stable support for the container. A closure band is secured to the sleeve adjacent the upper end thereof. The band is longitudinally adjustable so that the diameter of sleeve can be varied at the upper end thereof allowing various sized beverage containers to be positioned and tightly engaged within the sleeve.

It is yet another objective of the present invention to provide a collapsible multi-layer insulator for a beverage container which can be easily attached to a belt or a key ring for conveniently carrying the container.

In another aspect of the invention, this objective is met by providing a multi-layer carrier which has a ring and a clip attached to an exterior side of the container lid.

Other objects, features and advantages of the present invention will become apparent to those skilled in the art from the following detailed description. It should be understood, however, that the detailed description and specific examples while indicating preferred embodiments of the present invention, are given by way of illustration and not limitation. Many changes and modifications within the scope of the invention may be made without departing from the spirit thereof, and the invention includes all such modifications.

DETAILED DESCRIPTION OF THE PREFERRED EMBODIMENTS

Figure 1:
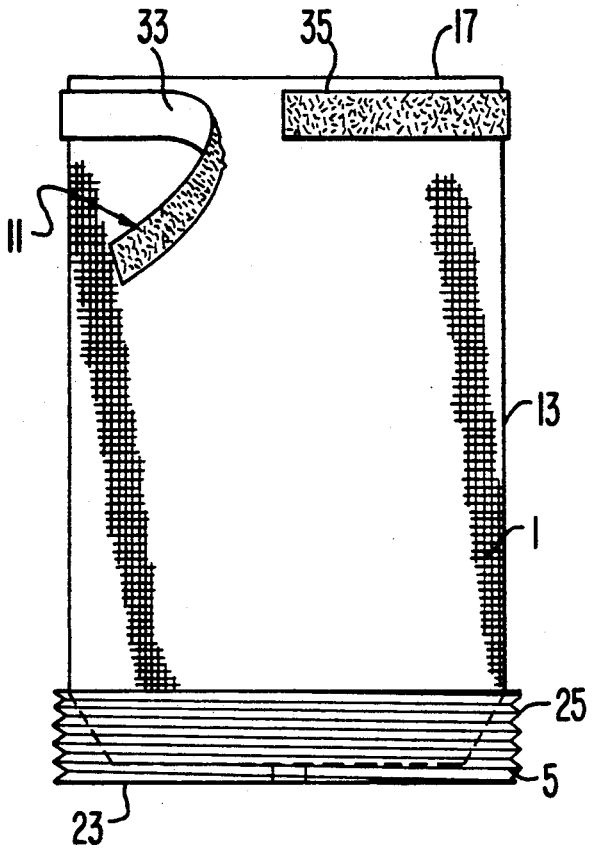
FIG. 1 is a front view of the main sleeve and base portion of a multi-layer insulator.
Figure 2:
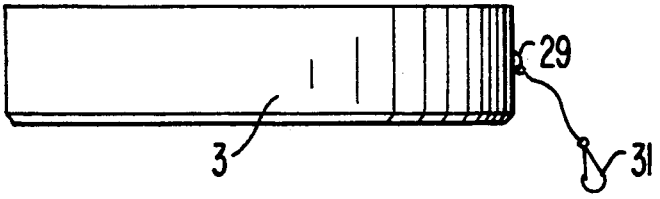
FIG. 2 is a front view of the carrier lid of a multi-layer insulator.
Figure 3:
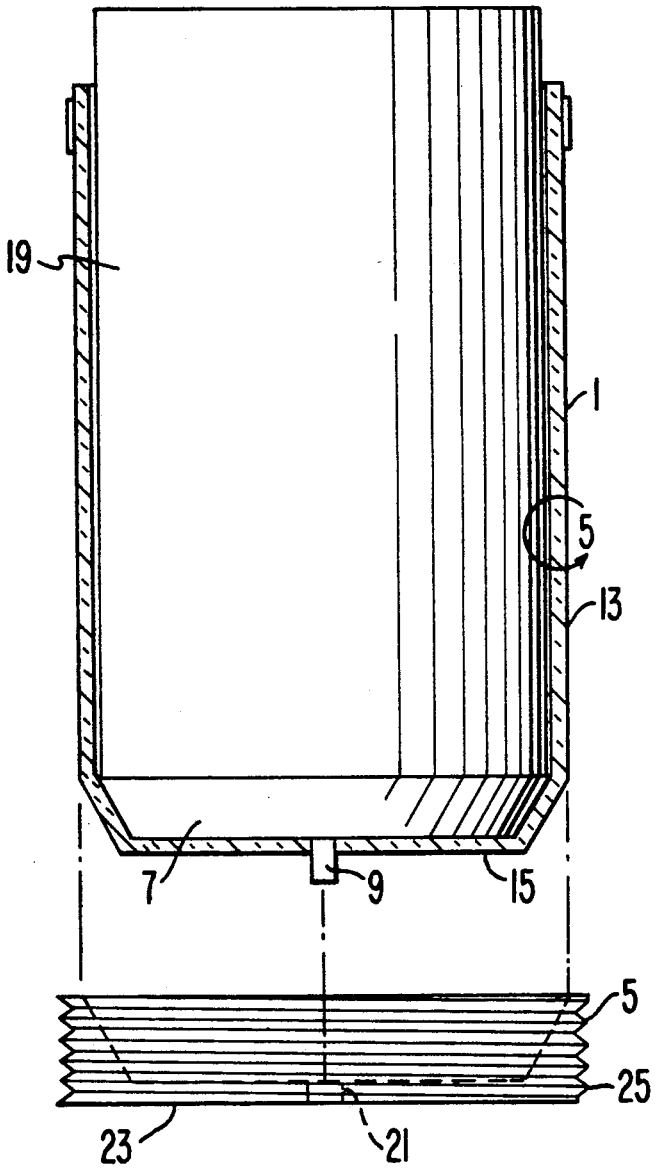
FIG. 3 shows, in separated condition, a cross-section of a beverage container and a main sleeve, and the base portion of the multi-layer insulator.

Referring to FIGS. 1–3, there is shown a multi-layer insulator for a beverage container consisting primarily of a main sleeve 1, a lid 3, a base 5, a base plate 7, a finger 9, and a closure band 11. Main sleeve 1 has side wall 13, bottom wall 15 and an open end 17 which permits the insertion of a container 19 into sleeve 11. Base plate 7 is attached to bottom wall 15 and is provided with finger 9 which extends through bottom wall 15 and into a hole 21 which is centrally located in a bottom wall 23 of base 5. During assembly, finger 9 is heated so that it mushrooms in hole 21 thereby securing main sleeve 11, base plate 7 and base 5 together in forming a base assembly.

Figure 4:
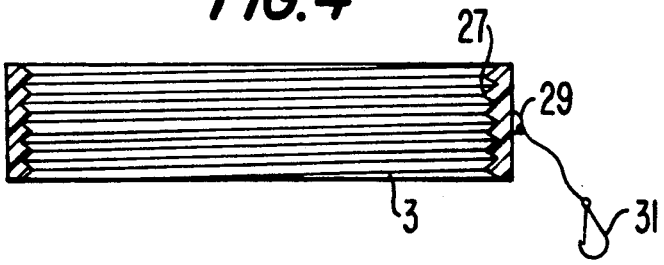
FIG. 4 is a sectional view through the carrier lid shown in FIG. 2.

As shown in FIG. 1, base 5 has external threads 25 which are adapted to receive the internal threads 27 of lid 3 (shown in FIG. 4). The relationship of base 5 to lid 3 is an important aspect of the invention because when the carrier is not in use, the side wall 13 of main sleeve 11 can be collapsed into the base 5. Lid 3 is then screwed onto base 5 providing a self-contained carrying case for the multi-layer insulator. To further enhance the ability to conveniently carry the insulator, a ring 29 is attached to lid 3 and a clip 31 is attached to ring 29. Thus, the insulator can be attached to such items as a key ring or a belt.

Conversely, when the insulator is being used, the lid is unscrewed from the base, turned over, and screwed to the bottom of base 5, creating a very stable base configuration for supporting the container 19. Sleeve 11 is then pulled up to fit around container 19.

Referring to FIG. 1, a closure band preferably formed of two "VELCRO" strips 33, 35 is attached to an upper end of sleeve 11, although a continuous band with a free end portion could also be provided. In either event, the top of the sleeve is gathered tightly around the top of the container, and the "VELCRO" strips then secured to each other. The sleeve can thus be adjusted to tightly engage sleeve 11 around various size containers 19.

Figure 5:
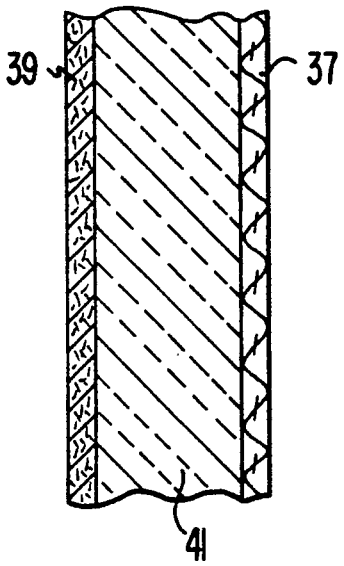
FIG. 5 is a fragmentary section of the side wall of the insulator illustrated in FIG. 3.

Referring to FIG. 5, sleeve 11 consists of an exterior fabric layer 37 preferably made from "LYCRA", an interior layer 39 which can be made from an aluminized fabric or neoprene, and an insulating layer 41 disposed between the layers 37, 39. The insulating layer is preferably made from "THINSULATE". The exterior layer 37 provides an excellent surface for screening designs onto it while the interior layer 39 prevents condensation from occurring. Insulating layer 41 is extremely efficient in minimizing heat transfer between the outside environment and the contents of container 19. Therefore, because of its resistance to condensation and its insulation efficiency, the multi-layered insulator is extremely useful in environments that are both hot and humid.

What is claimed is:

1. A multi-layer collapsible and insulative carrier for a container comprising:

an externally threaded base having top and bottom surfaces with a hole disposed in the center of said bottom surface;

a collapsible main sleeve extending upwardly from said base, said sleeve having an open upper end for receiving a container, and collapsible side and bottom walls, said side comprising an exterior fabric layer, an interior fabric layer spaced from said exterior layer, and a layer of insulating material in said space;

a base plate attached to said bottom wall of the main sleeve thereby forming a base assembly with said externally threaded base;

connecting means secured to said base plate and extending from said base plate through said bottom wall of said main sleeve and said hole in said base for interconnecting said main sleeve, said base plate and said base;

a lid having internal threads for screwing said lid over said externally threaded base, such that when said carrier is not in use said main sleeve can collapse into said base with said lid screwed on top of said base and collapsed main sleeve, thereby enclosing said sleeve, and when said carrier is to be used, said lid can be unscrewed, the sleeve extended to receive the container, and the lid turned upside-down and screwed onto said base from the bottom thereof; and a closure band secured to said sleeve adjacent the upper end thereof, said band being longitudinally adjustable to vary the diameter of said sleeve at the upper end thereof so that various sized beverage containers can be positioned within said sleeve and tightly engaged thereby.

2. The multi-layer carrier of claim 1, wherein said closure band is formed of two engageable strips.

3. The multi-layer carrier of claim 1, wherein said interior layer is an aluminized fabric.

4. The multi-layer carrier of claim 1, wherein said interior layer is a neoprene coated fabric.

5. The multi-layer carrier of claim 1, wherein said lid further includes carrying means attached to said lid so that said carrier can be easily carried.

6. The multi-layer carrier of claim 5, wherein said carrying means comprises a ring formed on an exterior of the lid, and a clip attached to said ring.

7. The multi-layer carrier of claim 1, wherein said base assembly is plastic.

8. The multi-layer carrier of claim 1, wherein said connecting means comprises a finger connected to said base plate and extending through holes in the bottom wall of the main sleeve and base, said finger being heated to mushroom at the bottom of the base thereby securing the main sleeve, the base plate and the base together as one base assembly.

* * * * *